United States Patent [19]

Beckenfeld

[11] 4,448,303

[45] May 15, 1984

[54] POINT OF SALE DISPLAY CONTAINER

[76] Inventor: Ronald Beckenfeld, 1535 Carla Ridge, Beverly Hills, Calif. 90210

[21] Appl. No.: 478,571

[22] Filed: Mar. 24, 1983

[51] Int. Cl.[3] ..... B65D 5/44

[52] U.S. Cl. ..... 206/44 R; 206/45.19

[58] Field of Search ..... 206/45.19, 45.14, 45.18, 206/459, 463, 462, 44 R, 45.31; 229/92.9

[56] References Cited

U.S. PATENT DOCUMENTS

| | | | |
|---|---|---|---|
| 480,045 | 8/1892 | Sommer | 206/45.18 |
| 823,817 | 6/1906 | Stack | 229/92.9 |
| 1,098,897 | 6/1914 | Gardner | 206/45.19 |
| 1,748,256 | 2/1930 | Tinsley | 206/45.19 |
| 1,901,583 | 3/1933 | Conway | 206/45.14 |
| 2,292,450 | 8/1942 | Kohn | 206/459 |
| 2,333,715 | 11/1943 | Hahnemann | 206/45.14 |
| 2,838,166 | 6/1958 | Herdklotz | 206/45.19 |
| 2,884,127 | 4/1959 | Neary | 206/462 |

*Primary Examiner*—William T. Dixson, Jr.

*Attorney, Agent, or Firm*—Nilsson, Robbins, Dalgarn, Berliner, Carson & Wurst

[57] ABSTRACT

A container which may be utilized for the display and housing of articles at the point of sale which includes a box having a flat surface supported above the bottom thereof to provide a plenum. The flat surface defines a plurality of slits, each of which is adapted to receive a tongue extending from an elongate pocket which is adapted to receive and hold the article which is to be displayed and sold.

7 Claims, 8 Drawing Figures

FIG. 4
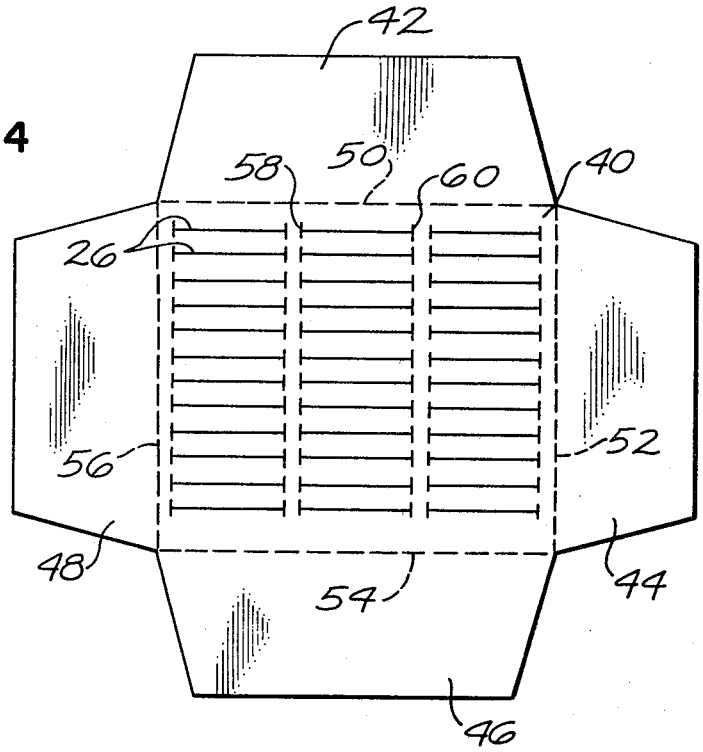
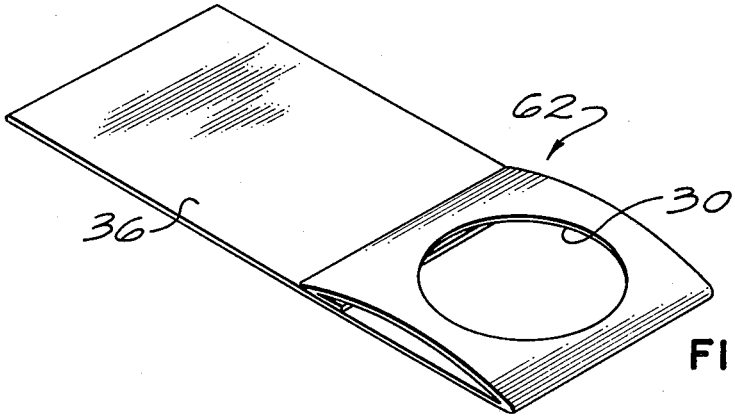
FIG. 5
FIG. 6
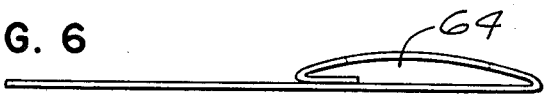
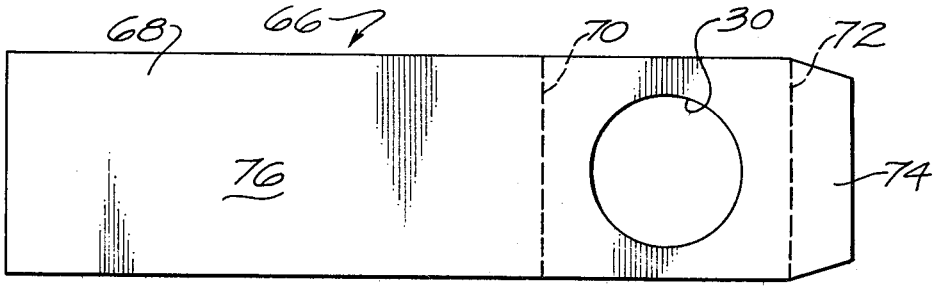
FIG. 7

POINT OF SALE DISPLAY CONTAINER

BACKGROUND OF THE INVENTION

This invention relates to a container for retaining and displaying a plurality of individually packaged items.

There have been many types of containers adapted to hold and display a plurality of articles at the point of sale. One such device is shown in U.S. Pat. No. 3,768,639 which discloses a vacuum formed tray which is set within a box and which includes a plurality of identical recesses within which there is loosely received the articles to be displayed and sold. A siilar structure is shown in the U.S. Pat. No. 1,098,897 which includes a pasteboard member having cut out openings in the top thereof, with individual pockets suspended beneath each of the openings to loosely receive the article to be displayed.

Other types of prior art containers for articles are typically open boxes or trays for containing various articles such as those shown in U.S. Pat. Nos. 1,263,819; 1,366,433; 1,996,965; 2,312,595; 2,902,200; 3,869,077 and 4,350,249.

As is well known, it is common to secure packaged articles upon cards which are then openly displayed at the point of sale and are arranged to permit the customer to remove the article from the display card. Such devices are shown in U.S. Pat. Nos. 1,402,635 and 1,940,078. A typical individual container for articles such as jewelry and well known to those in the art is for example shown in U.S. Pat. No. 3,788,123. U.S. Pat. No. 4,011,943 discloses a transporting container which includes a plurality of trays each in turn containing articles to be sold and arranged so the trays can be removed one at a time for display and sale, similar to an open box or tray containing the articles.

Though all of the prior art devices known and above generally described are effective, they do not provide the ability to easily contain and display a plurality of prepackaged items in a container which can be utilized to protect the prepackaged items other than during the time that they are to be displayed and sold and at the same time providing some security in that to remove an individual package from the container requires some force to separate it therefrom.

The present invention is particularly useful to receive and display for sale individual daily doses of food supplements such as vitamin tablets. Vitamins or groups of vitamins providing a daily dosage are not usually sold individually because of the packaging costs and time required to unpack the small articles. Typically, vitamins are sold in bottles containing a large number of an individual vitamin or alternatively where vitamins are packaged for daily dosages they are contained in a box or can requiring the purchaser to obtain large quantities thereof at one time.

SUMMARY OF THE INVENTION

A container for point of sale display including a box defining a surface supported above the bottom wall thereof and defining a plenum. The surface defines a plurality of slits communicating with the plenum in such a manner as to receive individually within each of the slits a flat pocket defining member having a tongue extending therefrom, thus allowing the tongue to enter the plenum with the pocket containing the article to be sold disposed above the surface.

BRIEF DESCRIPTION OF THE DRAWINGS

FIG. 4 is a top plan view of a blank utilized for forming the support surface to receive the individually packaged items for display;

FIG. 5 is a perspective view of the individual package for receiving the article to be displayed and sold;

FIG. 6 is a side elevational view of the package shown in FIG. 5;

FIG. 7 is a top elevational view of a blank used to form the package shown in FIG. 5.

DETAILED DESCRIPTION

Figure 1:
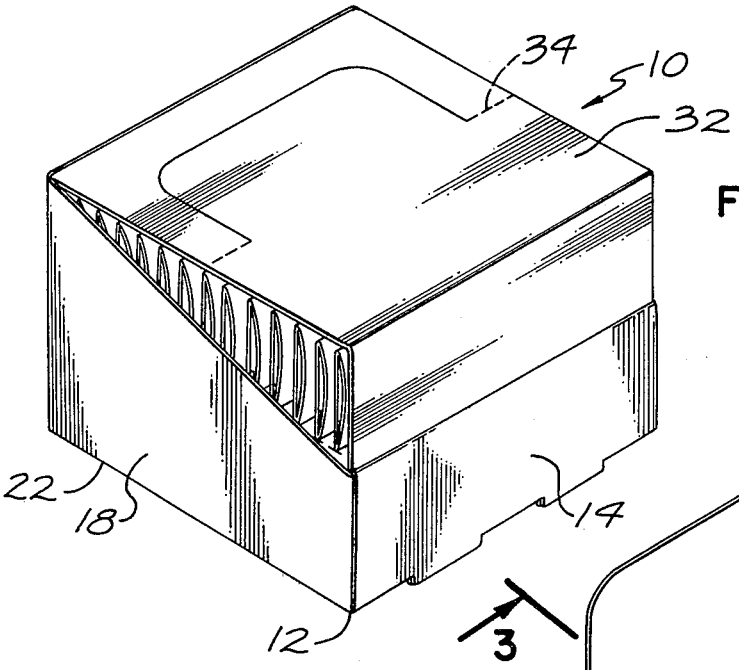
FIG. 1 is a perspective view of a container constructed in accordance with the present invention with the cover closed.
Figure 2:
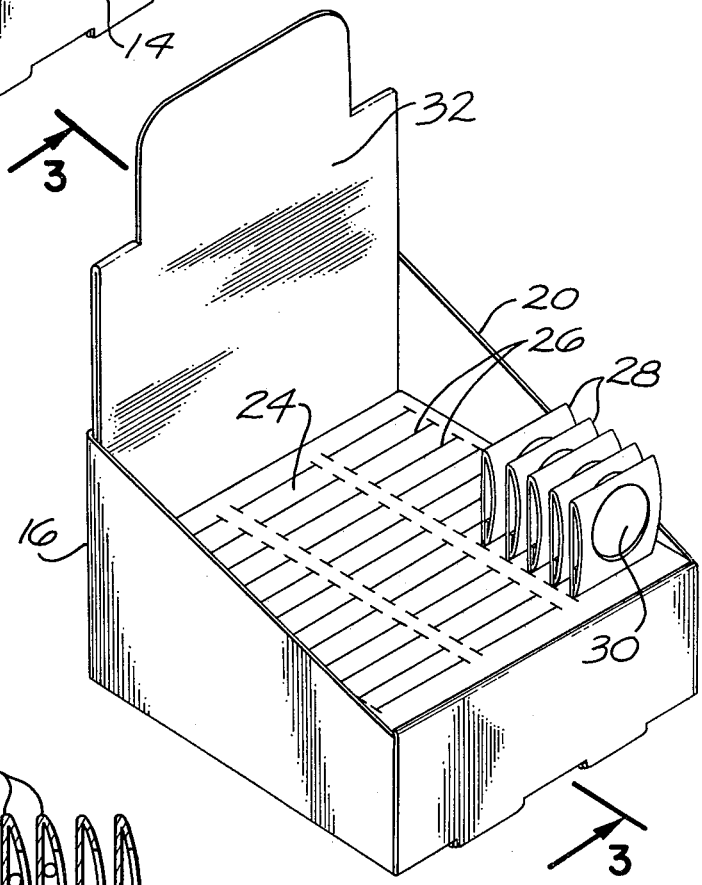
FIG. 2 is a perspective view of the container of FIG. 1 with the cover open and in an easel display format showing the individually packaged items for sale.

The container 10 shown generally in FIGS. 1 and 2 is particularly adapted for the retention and display of individually packaged items each of which is difficult to independently display other than loosely in a box or container. The individual items are prepackaged and then placed within a pocket which if desired can have an opening for viewing of the articles. The pocket is then supported upon a flat surface which holds the article in an upright position so that it can be readily and easily viewed by the consumer and each of the pockets can be independently removed from the container along with the article housed therein.

As is shown in FIGS. 1 and 2, the container in accordance with the present invention includes a box 12 having front and rear walls 14 and 16 and two side walls 18 and 20 as well as a bottom wall 22. A planar surface 24 is supported above the bottom surface 22 to define a plenum therebetween. The surface 24 has a plurality of slits 26 cut therethrough to provide communication with the plenum therebeneath. Pocket defining members 28 are arranged to be received individually within the slits 26 individually with each of the members 28 having a window or the like formed therein as shown generally at 30 to provide visual perception of the article contained within the pocket defined by the member 28. As is noted particularly in FIG. 2, the rear wall 16 may be configured in such a way as to provide an easel 30 upon which appropriate advertising material may be imprinted. Such easel 30 is formed by the lid 32 of the box which when in the position shown in FIG. 2 operates to be inserted between the planar surface 24 and the front wall 14 of the box to thus provide some security and ability for transportation of the container 10 with its contents in place. In changing the structure in FIG. 1 to that shown in FIG. 2 the top lid 32 is merely removed, folded about the fold line 34 and tucked between the rear wall 16 and the planar surface 24.

Figure 3:
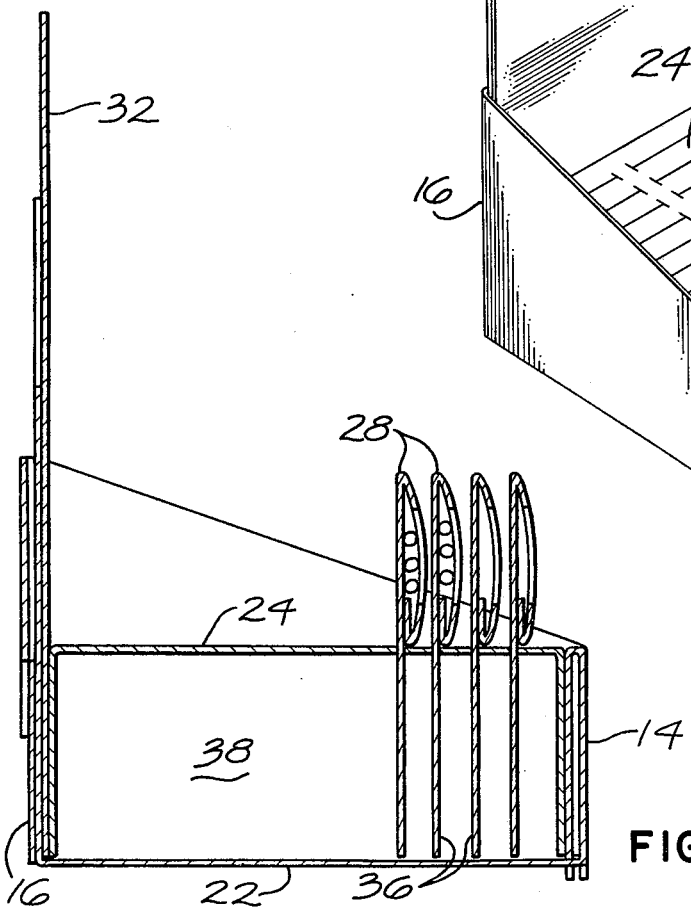
FIG. 3 is a cross-sectional view taken about the lines 3—3 of FIG. 2.

By referring to FIG. 3, the construction of the container is further illustrated. As is therein shown, the individual packages 28 containing the merchandise displayed and sold have a tongue 36 which enters a plenum 38 formed between the planar surface 24 and the bottom 22 of the box. As is also illustrated, the slits 26 are formed in such a way that the tongues 36 can be placed within the slit and sufficient pressure is applied to hold the packages 28 in position for display. The planar surface 24 is positioned within the box through the utilization of a blank so that it can be folded and slipped into position without the necessity of utilizing any type of adhesive. The blank is shown in FIG. 4 to which reference is hereby made. As is shown in FIG. 4 a body section 40 forms the planar surface 24. Extending from the body section 40 are four orthogonally positioned flaps 32 through 48 each of which is joined to the body 40 by an appropriate fold line 50 through 56 respectively. As is shown, the slits 26 are formed to provide a plurality thereof across the body 40 and are preferably formed by die cutting completely through the body 40 to provide communication therethrough with the plenum 38 as shown in FIG. 3 to permit easy insertion of the tounges 36 through the slits 26. Each of the slits is terminated at each end thereof by a transverse cut 58–60 which goes completely through the body 40 as do the slits 26. Through the utilization of the transverse cuts a pair of lips or flaps are effectively formed so that when the tongues 36 are inserted through the slits 26 the lips will effectively be depressed somewhat into the plenum 38 and there will tend to grip the tounges 36 and provide friction which must be overcome to remove the package 28 from the display container. With sufficient force the edges forming the slits 26 will reverse their position and relinquish the tongue 36 to the customer who is attempting to remove the package 28 from the container.

The structure of the package 28 is more clearly shown in FIGS. 5 through 7 to which reference is hereby made. As is illustrated, the package includes the tongue 36 with a pocket defining section 62 at the opposite end thereof. The pocket defining section 62 includes the opening 30 therein so that the contents which are held within the pocket 64 can be readily seen by the consumer. As is shown, the pocket has one side edge (at least) which is open so that the packaged goods such as the vitamin tablets shown in FIG. 5 may be inserted into the pocket 64 and removed from the pocket 64 relatively easily. The pocket is constructed preferably from a single member as shown at 66 which includes a body or strip portion 68 which has a pair of folds lines 70 and 72 with the opening 30 formed therein. At the terminal section 74 there is provided an additional flap 74. When the body 68 is folded upon itself about the two fold lines 70 and 72, the lip or flap 74 then engages the surface 76 of the body 68 as shown better in FIG. 6 and is secured in place by an adhesive or the like. As a result, the poket 64 is formed into which the packaged vitamins or similar goods can be easily inserted.

Figure 8:
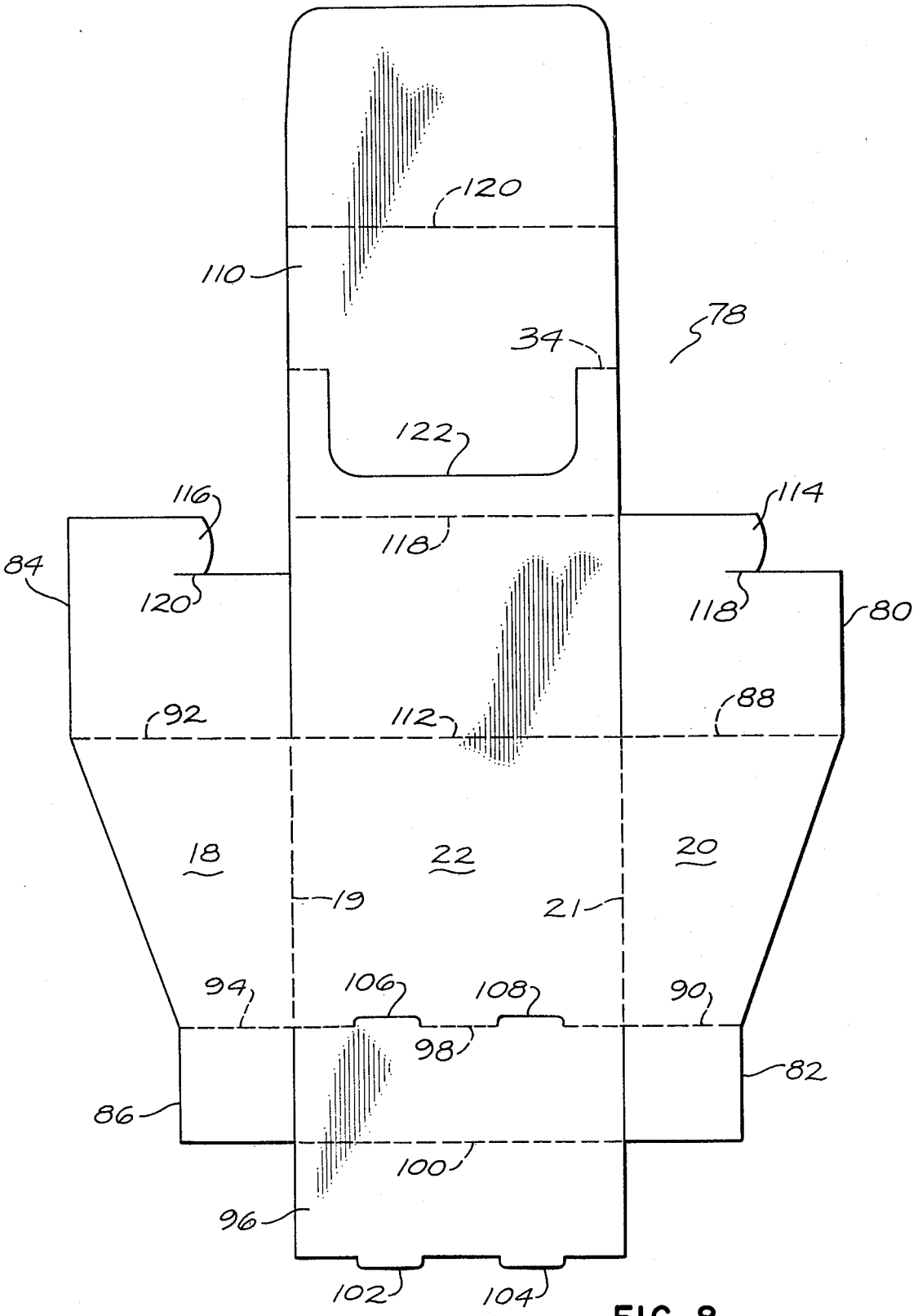
FIG. 8 is a top plan view of a blank used to form the box forming part of the container in accordance with the present invention.

The box is constructed from a single blank as shown in FIG. 8 to which reference is hereby made. As is shown in FIG. 8, the blank 78 includes a body section which forms the bottom 22 of the box. A pair of side flaps are joined to the bottom 22 along lines 19 and 21 and form the two side edges 18 and 20. Extending from the flap forming the side edge 20 are a pair of portions 80 and 82 while extending from the flap forming the side edge 18 are a pair of portions 84 and 86. These extended portions 80 through 86 are secured to the side edges 20 and 18 respectively by fold lines 88 through 94 respectively.

The front wall of the box is formed by a forwardly extending flap 96 which is connected to the bottom 22 by a fold line 98 an intermediate thereof is an additional fold line 100. The flap also includes a pair of forwardly extending tabs 102 and 104. In addition the fold line 98 is interrupted by a pair of openings 106 and 108 positioned to receive the tabs 102 and 104. In construction of the box to form the front wall 14 thereof, the two side walls are bent upwardly as viewed in FIG. 8 along the fold lines 19 and 21. Thereafter the portions 82 and 86 are bent toward each other along the fold lines 90 and 94. Subsequently the flap 96 is folded upwardly along the fold line 98 and then downwardly around the portions 82 and 86 and the tabs 102 and 104 are inserted into the openings 106 and 108 to secure the portions 82 and 86 in place thereby providing a sturdy frontwall 14 for the box.

Extending upwardly from the bottom 22 is a flap 110 which is connected to the bottom 22 by the fold line 112. In forming the back wall 16 of the box the flap 110 is folded upwardly about the fold line 119. The two portions 80 and 84 are then folded along the lines 88 and 92 respectively and the two opposed tongues 114 and 116 are interlocked along the slots 118 and 120 provided therein. Thus the backwall is secured and formed in place. Thereafter the flaps 42 through 48 of the planar surface defining member are folded downwardly as viewed in FIG. 4 and that structure is inserted into the box thus comprising the box structure.

As is also shown, the flap 110 includes a pair of additional fold lines, 118 and 120 to provide the cover portions of the box as shown in FIG. 1. The dye cut 122 is provided as the fold line 34 to provide the ability to make the easel display as shown in FIG. 2.

From a consideration of the foregoing description those skilled in the art will now recognize that the container constructed in accordance with the present invention includes the three component parts of the box the insert forming the planar surface with the slits therein and the individual pocket defining members having the tongues which fit within the plenum. All three of the component parts are constructed from a die cut blank which occupies a relatively small amount of space when it is in its flat and unfolded condition. The blanks may be easily and readily folded along the fold lines or creases formed therein and the insert dropped in place with the packaged goods inserted therein either before or after the box is constructed. The lid can then be closed for transport or storage and opened for display at the point of sale to the customer. The specific construction of the container provides ready display along with some security and provides easy packaging for individual sale and use of goods previously difficult for distribution and individual consumption units.

What is claimed is:

1. A container for point of sale display and retention of articles comprising:

a recti-linear box having a bottom, front, rear and two sidewalls;

an insert comprising a flat body having four orthogonally disposed flaps extending therefrom with a fold line at the intersection between each flap and said body, said flaps being foldable for insertion into said box with the flaps having engagement with said bottom wall thereof to support said body for defining a planar surface supported above said bottom wall at a level substantially the same as the height of said front wall, said planar surface being substantially co-extensive with said bottom wall and defining a plenum therewith;

said planar surface having a plurality of individual slits defined by cutting through said planar surface without removing material from said body; and a plurality of flat elongate pocket defining means having a flat tongue extending therefrom, one of said slits cooperatively receiving one of said tongues thereby allowing said tongue to enter said plenum, said pocket being supported above said surface for retaining said article therein, said pocket being open along at least one side thereof to permit articles to be readily inserted into and removed from said pocket, said pocket being formed by a pair of opposed flat walls, one of said walls defining an opening therethrough to provide visibility of an article received in said pocket.

2. A container as defined in claim 1 wherein each of said slits terminates with a transverse cut at each end thereof extending through said planar surface without removing material from said body for allowing the edges of said planar surface defining said slits to flex when said tongue is being inserted into or removed from said slit while at the same time providing some force against said tongue for supporting said pocket above said surface and for retaining said pocket defining means in said container until removed therefrom by the exertion of some removal force.

3. A container as defined in claim 2 wherein said pocket defining means is a unitary member including a flat strip having two fold lines transverse the longitudinal axis thereof, one of said fold lines being disposed adjacent the one terminal edge of said strip and the other fold line being disposed inwardly from said one fold line, said strip when folded toward itself along each fold line defining a lip along said one terminal edge and one flat wall of said pocket, said lip being adhesively secured to said strip, said strip defining the other flat wall of said pocket and also said tongue, said pocket being open along both side edges to permit said article to be inserted or removed from either side edge.

4. A container as defined in claim 3 wherein said opening is defined by said one flat wall.

5. A container as defined in claim 1 wherein said box includes a blank having a central portion defining said bottom and first, second, third and fourth orthogonally disposed outwardly extending portions joined to said body portion by a fold line to provide said front, rear and two side walls when folded, said first and third portions forming said side walls and each including a pair of flaps extending forwardly and rewardly therefrom and joined thereto by a fold line to form, with said second and fourth portions, said front and rear walls respectively.

6. A container as defined in claim 5 wherein said second portion includes a plurality of tabs extending from the terminal edge thereof and a centrally disposed fold line, said second portion, when folded about said central fold line and said joining fold line receiving said forwardly extending flaps between the folds thereof to form said front walls, said joining fold line for said second portion being interrupted by cuts disposed to receive said tabs for securing said folded portion in place.

7. A container as defined in claim 6 wherein said rearwardly extending flaps have, when folded, oppositely directed overlapping tongues operatively interlocking for retaining said fourth portion in its folded position to form said rear wall.

* * * * *